US012397884B2

(12) United States Patent
Takebe et al.

(10) Patent No.: US 12,397,884 B2
(45) Date of Patent: Aug. 26, 2025

(54) STEERING APPARATUS OF HYDROFOIL

(71) Applicant: HONDA MOTOR CO., LTD., Tokyo (JP)

(72) Inventors: Yuki Takebe, Wako (JP); Ryosuke Itai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 574 days.

(21) Appl. No.: 17/859,027

(22) Filed: Jul. 7, 2022

(65) Prior Publication Data

US 2023/0038542 A1 Feb. 9, 2023

(30) Foreign Application Priority Data

Aug. 2, 2021 (JP) ..... 2021-126608

(51) Int. Cl.
*B63B 32/64* (2020.01)
*B63H 25/42* (2006.01)

(52) U.S. Cl.
CPC ..... *B63B 32/64* (2020.02); *B63H 25/42* (2013.01)

(58) Field of Classification Search
CPC ..... B63B 32/64; B63B 1/246; B63B 1/285; B63H 25/42
See application file for complete search history.

(56) References Cited

U.S. PATENT DOCUMENTS

| | | | | |
|---|---|---|---|---|
| 2,906,228 A * | 9/1959 | Wendel | B63B 1/285 114/280 |
| 3,354,857 A * | 11/1967 | Hobday | B63B 1/125 114/282 |
| 11,878,769 B2 * | 1/2024 | Itai | B63B 1/248 |
| 2022/0388607 A1 * | 12/2022 | Rosen | B63B 1/28 |

FOREIGN PATENT DOCUMENTS

| | | | |
|---|---|---|---|
| CN | 108945334 B * | 6/2020 | B63B 32/00 |
| JP | 52-076095 | 6/1977 | |
| JP | 60-075198 | 5/1985 | |
| JP | 07-205891 | 8/1995 | |
| JP | 11-020775 | 1/1999 | |
| JP | 2016-175635 | 10/2016 | |

OTHER PUBLICATIONS

Japanese Office Action for Japanese Patent Application No. 2021-126608 mailed Apr. 22, 2025.

* cited by examiner

*Primary Examiner* — Anthony D Wiest
(74) *Attorney, Agent, or Firm* — Amin, Turocy & Watson, LLP

(57) ABSTRACT

A steering apparatus of a hydrofoil includes first to fourth propulsion portions, a central connecting portion, a left hydrofoil, and a right hydrofoil. Among the first to fourth propulsion portions, the first propulsion portion 41 and the third propulsion portion are disposed on the left side, and the second propulsion portion and the fourth propulsion portion are disposed on the right side. The central connecting portion connects the first to fourth propulsion portions with (Continued)

each other via a first fixing portion and a second fixing portion. A left hydrofoil and a right hydrofoil are respectively attached to outer sides of the central connecting portion via the first fixing portion and the second fixing portion.

5 Claims, 7 Drawing Sheets

STEERING APPARATUS OF HYDROFOIL

CROSS-REFERENCE TO RELATED APPLICATION

Priority is claimed on Japanese Patent Application No. 2021-126608, filed Aug. 2, 2021, the content of which is incorporated herein by reference.

BACKGROUND OF THE INVENTION

Field of the Invention

The present invention relates to a steering apparatus of a hydrofoil.

Description of Related Art

For example, as vessels, there are twin-screw vessels each being provided with a propeller shaft outside the vessel. Among the twin-screw vessels, a constitution is known in which a center web projects downward from a hull, shaft bracket arms project from the projecting center web in a downward gradient toward both sides, and devices for reducing driving force are respectively provided at tip ends on both sides (see, for example, Japanese Unexamined Patent Application, First Publication No. 2016-175635 A).

In such a device, for example, a propeller shaft and a fin (hereinafter, referred to as a hydrofoil) is provided at each tip end of the shaft bracket arms on both sides. A propeller is attached to the propeller shaft. Each of the fins and the shaft bracket arms are formed to be twisted by, for example, by changing the rotation of the propeller. The fins and the shaft bracket arms are twisted, so that, for example, the attack angles of the fins can be changed.

SUMMARY OF THE INVENTION

Regarding the hydrofoils in Japanese Unexamined Patent Application, First Publication No. 2016-175635 A, the shaft bracket arms on both sides are divided into two by the center web. Hence, the shaft bracket arms on both sides are twisted independently of each other, and thus the attack angles of the hydrofoils on both sides also change independently. According to the hydrofoils on both sides, it is possible to generate an inflow into the propeller by use of the induced pre-twist so as to further improve the driving efficiency.

However, the twin-screw vessel in Japanese Unexamined Patent Application, First Publication No. 2016-175635 A is not intended to sail above the water surface like a hydrofoil vessel. Even when the attack angles of hydrofoils on both sides are changed, it is impossible to cause the hull to make a turn. That is, the twin-screw vessel in Japanese Unexamined Patent Application, First Publication No. 2016-175635 A does not have a function as a steering apparatus for steering the hull.

An aspect of the present invention provides a steering apparatus of a hydrofoil capable of causing a hull to make a turn in a smooth manner, by changing attack angles of hydrofoils on both sides of the hull.

(1) A steering apparatus of a hydrofoil according to the present invention, the steering apparatus includes: at least one propulsion portion (for example, first to fourth propulsion portions 41 to 44 in an embodiment) each on a left side and on a right side; a central connecting portion (for example, a central connecting portion 12 in an embodiment) that connects the propulsion portions with each other; and a fin (for example, a left hydrofoil 55, a right hydrofoil 56, in an embodiment) attached to an outer side of the central connecting portion.

According to the constitution in an aspect of the above (1), at least one propulsion portion is disposed each on the left side and on the right side, and the propulsion portions disposed on the left side and on the right side are connected at the central connecting portion. Furthermore, the fin (hydrofoil) is attached to an outer side of the central connecting portion. Therefore, for example, by generating an output difference in propulsion force between one of the left and right propulsion portions and the other one, the attack angle of the fin attached to one side and the attack angle of the fin attached to the other side can be changed in opposite directions to each other. Therefore, for example, in causing the hull to make a turn through steering, it is possible to cause the hull to make a turn in a smooth manner.

(2) In the aspect of the above (1), the central connecting portion may include a left-side portion (for example, a left-side portion 12*a* in an embodiment) disposed on the left side and a right-side portion (for example, a right-side portion 12*b* in an embodiment) disposed on the right side, and the left-side portion and the right-side portion are integrally continuous with each other.

According to the constitution in an aspect of the above (2), the left-side portion and the right-side portion of the central connecting portion are integrally continuous with each other, and the left-side portion and the right-side portion are constituted not to be divided into the left and right parts. Therefore, for example, by generating torque on one side of the central connecting portion with the propulsion force of the propulsion portions, the torque on one side enables transmission of twisting to the other side. Accordingly, in conjunction with the twisting on one side of the central connecting portion, the twisting can be generated on the other side.

(3) In the aspect of the above (1), the central connecting portion may include a left-side portion (for example, a left-side portion 12*a* in an embodiment) disposed on the left side and a right-side portion (for example, a right-side portion 12*b* in an embodiment) disposed on the right side, and the left-side portion and the right-side portion are flush with each other.

According to the constitution in an aspect of the above (3), the left-side portion and the right-side portion of the central connecting portion are formed to be flush with each other. Therefore, for example, the twisting on one side of the central connecting portion can be efficiently transmitted to the other side. Accordingly, in conjunction with the twisting on one side of the central connecting portion, the twisting can be generated on the other side in an efficient manner.

(4) In the aspect of the above (1), the central connecting portion may include a first central connecting portion (for example, a first central connecting portion 21 in an embodiment) and a second central connecting portion (for example, a second central connecting portion 22 in an embodiment) which are disposed vertically as two pieces.

According to the constitution in an aspect of the above (4), the first central connecting portion and the second central connecting portion are vertically provided as two pieces. Therefore, it is possible to generate torque in opposite directions to each other between one side of the first central connecting portion and one side of the second central connecting portion by the propulsion force of the propulsion portions. Accordingly, one side of the first central connecting portion and one side of the second central connecting portion are twisted in opposite directions to each other, and such twisting can be transmitted respectively to the other side of the first central connecting portion and the other side of the second central connecting portion. Therefore, the first central connecting portion and the second central connecting portion can be twisted in conjunction with each other.

(5) The aspect of the above (4) may further include: a first fixing portion (for example, a first fixing portion 35 in an embodiment) that fixes each left side of the first central connecting portion and the second central connecting portion, the first fixing portion being attached with the fin (for example, a left hydrofoil 55 in an embodiment) disposed on a left outer side; and a second fixing portion (for example, a second fixing portion 37 in an embodiment) that fixes each right side of the first central connecting portion and the second central connecting portion, the second fixing portion being attached with the fin (for example, a right hydrofoil 56 in an embodiment) disposed on a right outer side.

According to the constitution in an aspect of the above (5), each left side of the first central connecting portion and the second central connecting portion is fixed by the first fixing portion, and each right side of the first central connecting portion and the second central connecting portion is fixed by the second fixing portion. Therefore, for example, by generating torque in the first fixing portion at the propulsion portion in a clockwise direction, when viewed from the right side of the hull, torque in the opposite directions to each other is generated on one side of the first central connecting portion and one side of the second central connecting portion. Specifically, one side of the first central connecting portion and one side of the second central connecting portion are twisted in opposite directions to each other, and such twisting can be transmitted respectively to the other side of the first central connecting portion and the other side of the second central connecting portion.

Accordingly, by twisting the first central connecting portion and the second central connecting portion in conjunction with each other, torque in the opposite directions to each other can be generated in the second fixing portion in a counterclockwise direction in conjunction with the first fixing portion, when viewed from the right side of the hull. Hereinafter, the "clockwise direction when viewed from the right side of the hull" will be abbreviated as a "clockwise direction" in some cases, and the "counterclockwise direction when viewed from the right side of the hull" will be abbreviated as a "counterclockwise direction" in some cases.

(6) In the aspect of the above (1), the central connecting portion may include a first central connecting portion (for example, a first central connecting portion 21 in an embodiment) and a second central connecting portion (for example, a second central connecting portion 22 in an embodiment) to be disposed vertically as two pieces, and each of the first central connecting portion and the second central connecting portion is formed in a flat plate shape.

According to the constitution in an aspect of the above (6), each of the first central connecting portion and the second central connecting portion is formed in a flat plate shape. In addition, the first central connecting portion and the second central connecting portion are disposed to be vertically spaced apart from each other. Therefore, it becomes possible to have a torsion bar structure (torsion beam structure) with the central connecting portion, which is strong against bending, and in which arbitrary torsional rigidity is obtainable. Accordingly, the attack angles of the fins on both sides can be efficiently changed.

Further, the first central connecting portion and the second central connecting portion are disposed to be vertically spaced apart from each other, so as to enable water to pass through between the first central connecting portion and the second central connecting portion. Accordingly, the resistance of the flow of water to the central connecting portion can be reduced.

(7) In the aspect of the above (1), in the central connecting portion, a through hole (for example, a first through hole 31, a second through hole 32 in an embodiment) penetrating vertically at a central part in a left-right direction may be provided, and the steering apparatus further includes a support pin (for example, a support pin 25 in an embodiment) that penetrates the through hole from an up-down direction and that supports the central connecting portion.

According to the constitution in an aspect of the above (7), the through hole is formed in the central portion of the central connecting portion, and the support pin is made to pass through the through hole from the up-down direction. Therefore, with the support pin as an axis, the left-side portion disposed on the left side and the right-side portion disposed on the right side of the central connecting portion can be twisted while having the support pin as the axis. Accordingly, the left-side portion and the right-side portion of the central connecting portion can be constituted to be twisted in a simple constitution in which the central portion of the central connecting portion is simply supported by the support pin.

(8) In the aspect of the above (7), a margin in rotation that restricts a rotatable range of the central connecting portion with the support pin as a center may be set in the central connecting portion.

According to the constitution in an aspect of the above (8), the margin in rotation (for example, a space in which rotation is enabled with the support pin as the center) is set in the central connecting portion, and the rotatable range of the central connecting portion is restricted by the margin in rotation. Accordingly, a maximum allowable angle in the torsion of the central connecting portion can be set in a simple constitution in which the margin in rotation is simply set in the central connecting portion.

(9) In the aspect of the above (1), a plurality of the propulsion portions may be provided next to each other in a vertical direction of the central connecting portion, and the torsion may be generated in the central connecting portion by an output difference in the propulsion force of the propulsion portions provided vertically.

According to the constitution in an aspect of the above (9), the plurality of propulsion portions are provided next to each other in a vertical direction of the central connecting portion, and torsion is generated in the central connecting portion by an output difference in the propulsion force of the propulsion portions provided vertically. That is, it is possible to generate twisting in opposite directions to each other between one side and the other side (the left side and the right side) of the central connecting portion. Therefore, the attack angle of the fin attached to one side and the attack angle of the fin attached to the other side can be changed in opposite directions to each other. Therefore, for example, in causing the hull to make a turn through steering, it is possible to cause the hull to make a turn in a smooth manner, and the driving force (for example, electric power) in causing the hull to make a turn can be reduced.

According to an aspect of the present invention, it is possible to cause the hull to make a turn in a smooth manner, by changing attack angles of hydrofoils on both sides of the hull.

DETAILED DESCRIPTION OF THE INVENTION

Figure 1:
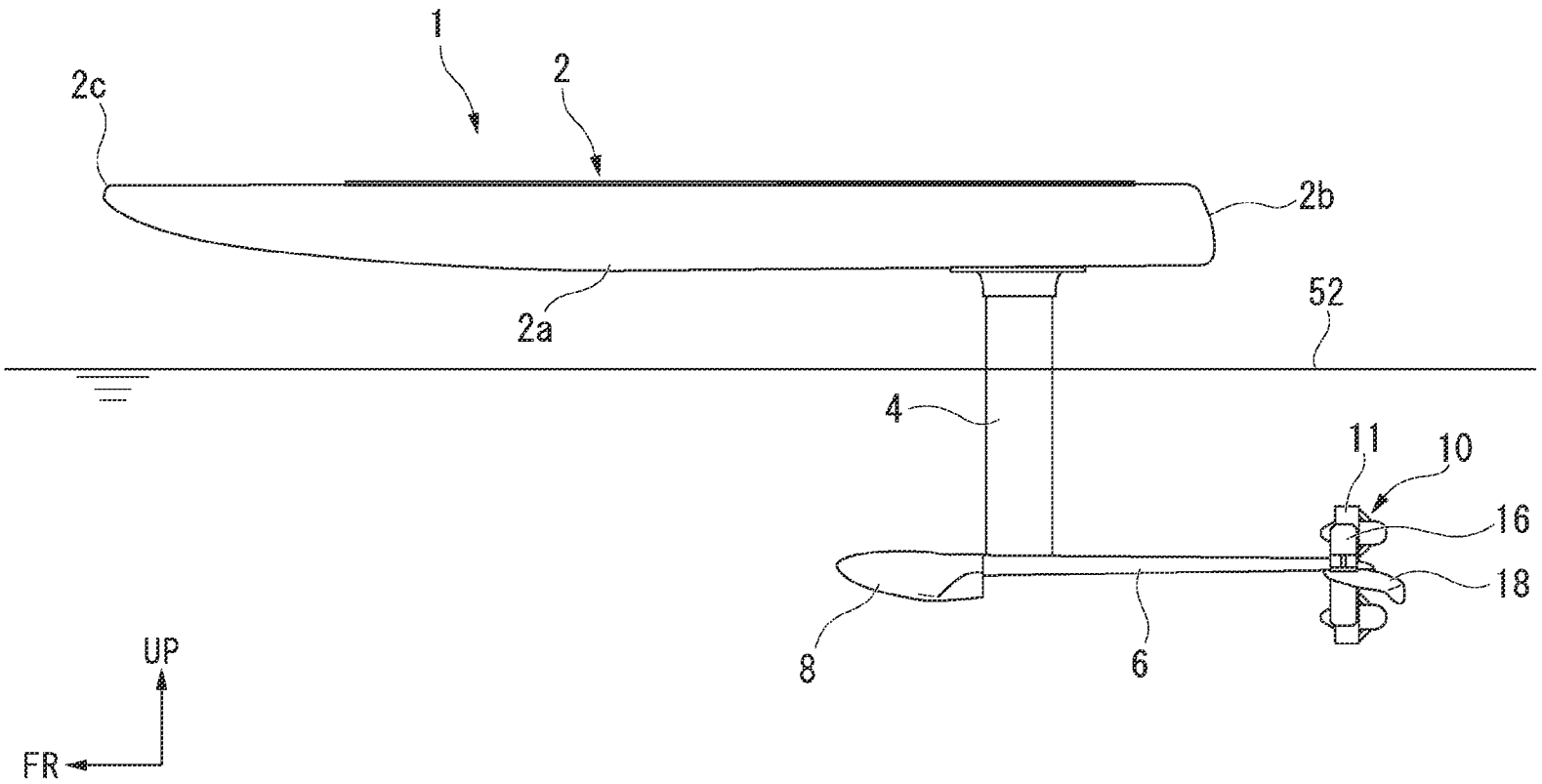
FIG. 1 is a side view illustrating a hydrofoil vessel including a steering apparatus of a hydrofoil according to an embodiment of the present invention.

Hereinafter, a hydrofoil vessel in an embodiment of the present invention will be described in accordance with the drawings. In the drawings, an arrow FR indicates a front side of the hydrofoil vessel, an arrow UP indicates an upper side of the hydrofoil vessel, and an arrow LH indicates a left lateral side of the hydrofoil vessel.

Figure 2:
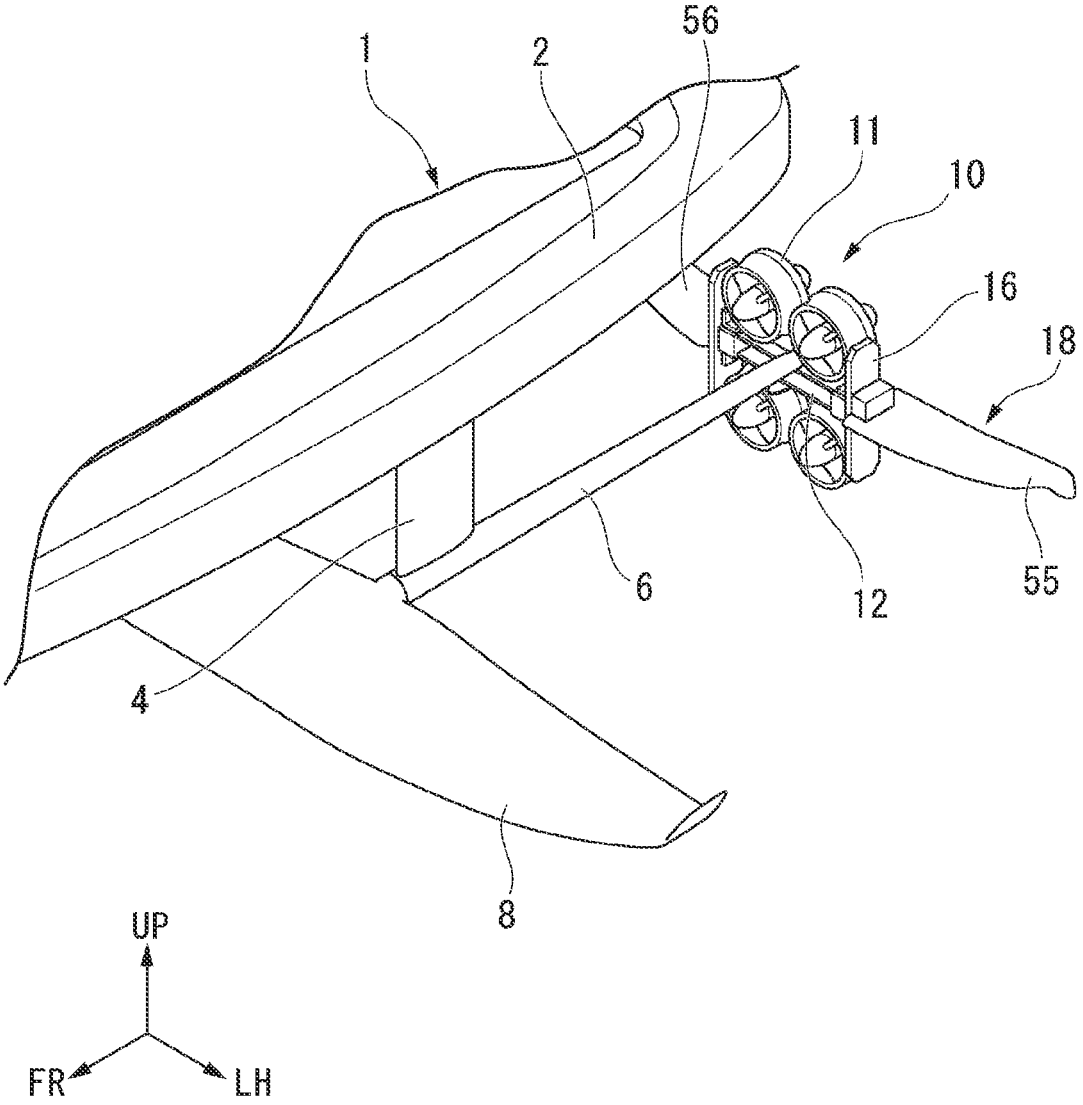
FIG. 2 is a perspective view of the hydrofoil vessel of FIG. 1, when viewed from a front side of a left upper side.

As illustrated in FIGS. 1 and 2, a hydrofoil vessel 1 includes a hull 2, a center web 4, a connecting arm 6, a front hydrofoil 8, and a steering apparatus 10 of the hydrofoil. Hereinafter, the steering apparatus 10 of the hydrofoil will be simply referred to as a "steering apparatus 10", in some cases.

The center web 4 is suspended downward from a part closer to a stern 2*b* and a central part in a left-right direction, on a vessel bottom 2*a* of the hull 2. The connecting arm 6 is provided at a lower end portion of the center web 4, and extends horizontally in a front-rear direction of the hull 2. The front hydrofoil 8 is provided at a front end portion of the connecting arm 6. The front hydrofoil 8 protrudes in the left-right direction of the hull 2 from a front end portion of the connecting arm 6. The steering apparatus 10 is provided at a rear end portion of the connecting arm 6.

Figure 3:
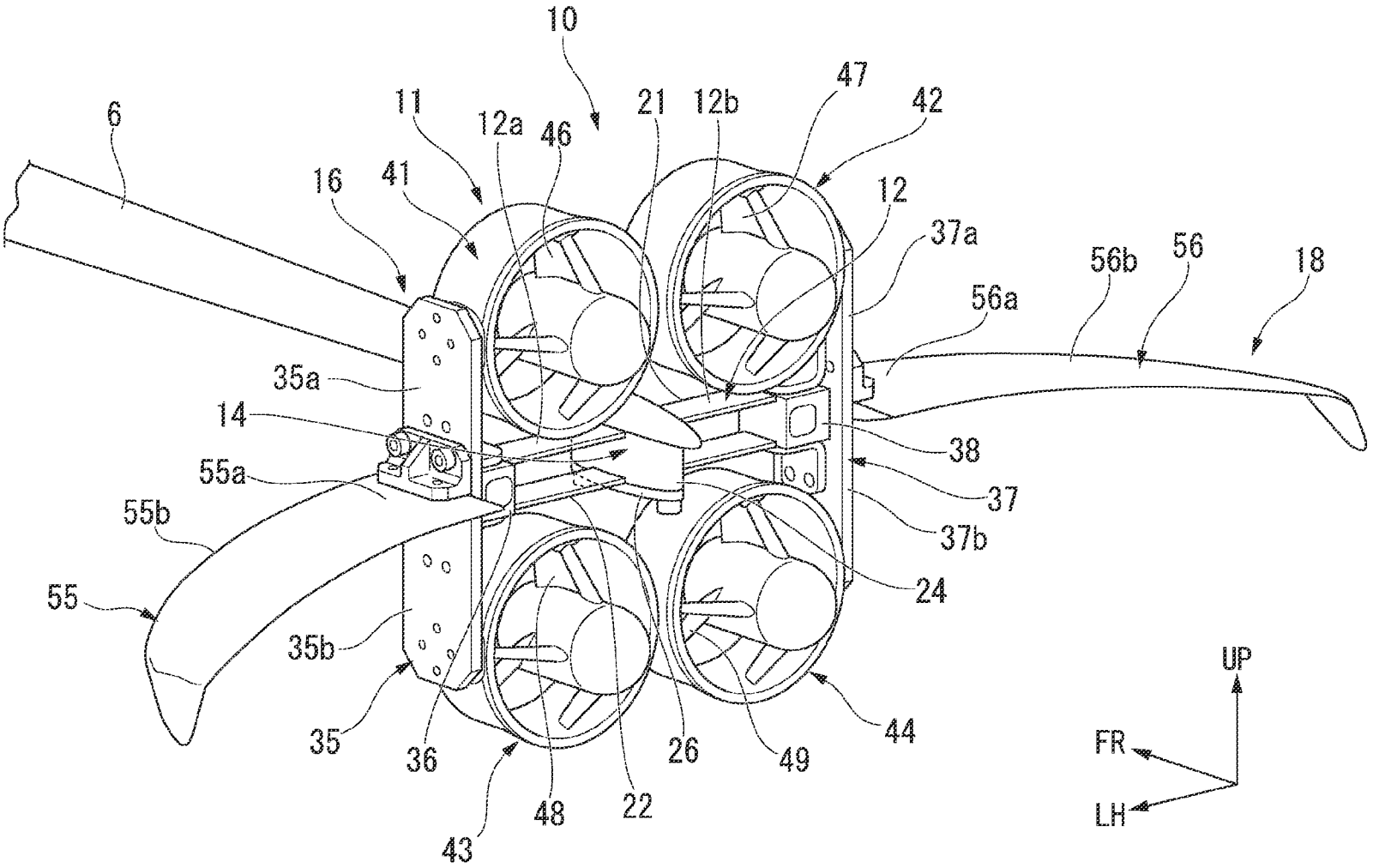
FIG. 3 is a perspective view of the steering apparatus of the hydrofoil according to an embodiment, when viewed from a left rear side.
Figure 4:
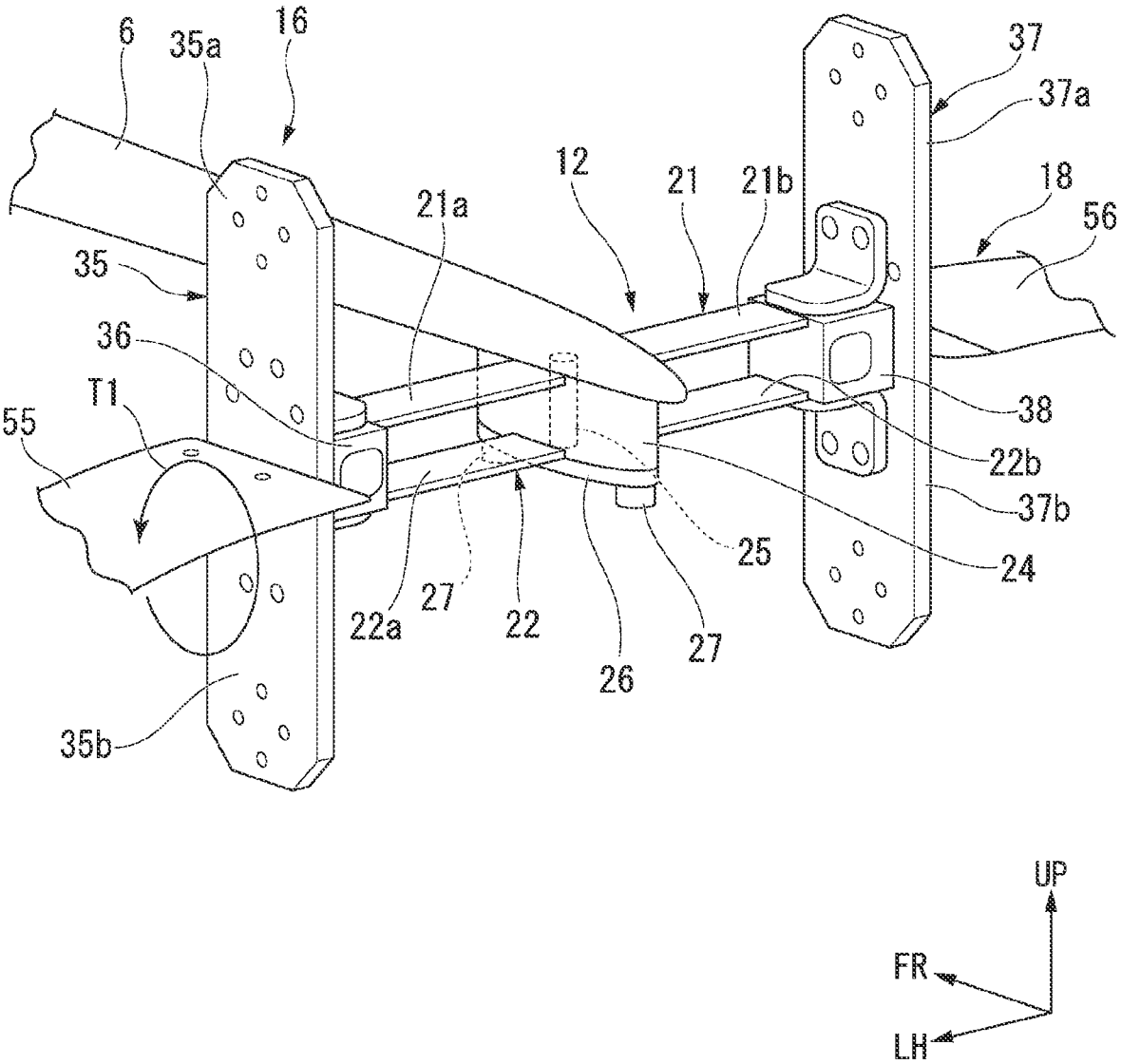
FIG. 4 is an enlarged perspective view in which a propulsion unit is removed from the steering apparatus of the hydrofoil of FIG. 3.

As illustrated in FIGS. 3 and 4, the steering apparatus 10 includes a propulsion unit 11, a central connecting portion (torsion bar, torsion beam) 12, a support portion 14, a fixing portion 16, and an rear hydrofoil 18. The propulsion unit 11 is attached to the central connecting portion 12 via the fixing portion 16 or the like. The propulsion unit 11 will be described later in detail.

The central connecting portion 12 is provided at a rear end portion of the connecting arm 6 via the support portion 14. The central connecting portion 12 includes two central connecting portions, which are a first central connecting portion 21 and a second central connecting portion 22. The first central connecting portion 21 and the second central connecting portion 22, which are the two central connecting portions, are disposed to be spaced apart from each other vertically, in a state in which the first central connecting portion 21 and the second central connecting portion 22 extend horizontally in the left-right direction of the hull 2.

The first central connecting portion 21 is disposed above (that is, on the hull 2 side of) the second central connecting portion 22. The first central connecting portion 21 includes a first left-side portion 21*a* disposed on a left side of the connecting arm 6, and a first right-side portion 21*b* disposed on a right side of the connecting arm 6. Among the first central connecting portion 21, the first left-side portion 21*a* is a part on the left side (one side) of a support pin 25 (to be described later). Among the first central connecting portion 21, the first right-side portion 21*b* is a part on the right side (the other side) of the support pin 25.

The first left-side portion 21*a* and the first right-side portion 21*b* are integrally and continuously formed in a flat plate shape. In addition, the first left-side portion 21*a* and the first right-side portion 21*b* are formed to be flush with each other.

The second central connecting portion 22 is disposed below the first central connecting portion 21, and extends along the first central connecting portion 21. Similarly to the first central connecting portion 21, the second central connecting portion 22 includes a second left-side portion 22*a* disposed on the left side of the connecting arm 6 and a second right-side portion 22*b* disposed on the right side of the connecting arm 6. Among the second central connecting portion 22, the second left-side portion 22*a* is a part on the left side (one side) of the support pin 25. Among the second central connecting portion 22, the second right-side portion 22*b* is a part on the right side (the other side) of the support pin 25.

The second left-side portion 22*a* and the second right-side portion 22*b* are each integrally and continuously formed in a flat plate shape. In addition, the second left-side portion 22*a* and the second right-side portion 22*b* are formed to be flush with each other.

As illustrated in FIG. 4, the first central connecting portion 21 and the second central connecting portion 22 are supported at the central portion in the left-right direction by the support portion 14. The support portion 14 includes a support block 24, a support pin 25, and a support cover 26.

The support block 24 is attached to a rear end portion of the connecting arm 6 with a bolt 27 from below, in a state in which a lower end portion of the support block 24 is covered with the support cover 26. The support pin 25 is accommodated in the up-down direction inside the support block 24. The support block 24 includes, for example, a recess or an opening that enables the first central connecting portion 21 and the second central connecting portion 22 to penetrate through in the left-right direction.

For example, an upper end portion of the support pin 25 is supported by the rear end portion of the connecting arm 6, and a lower end portion of the support pin 25 is supported by the support cover 26. The support pin 25 supports the first central connecting portion 21 and the second central connecting portion 22.

Figure 5:
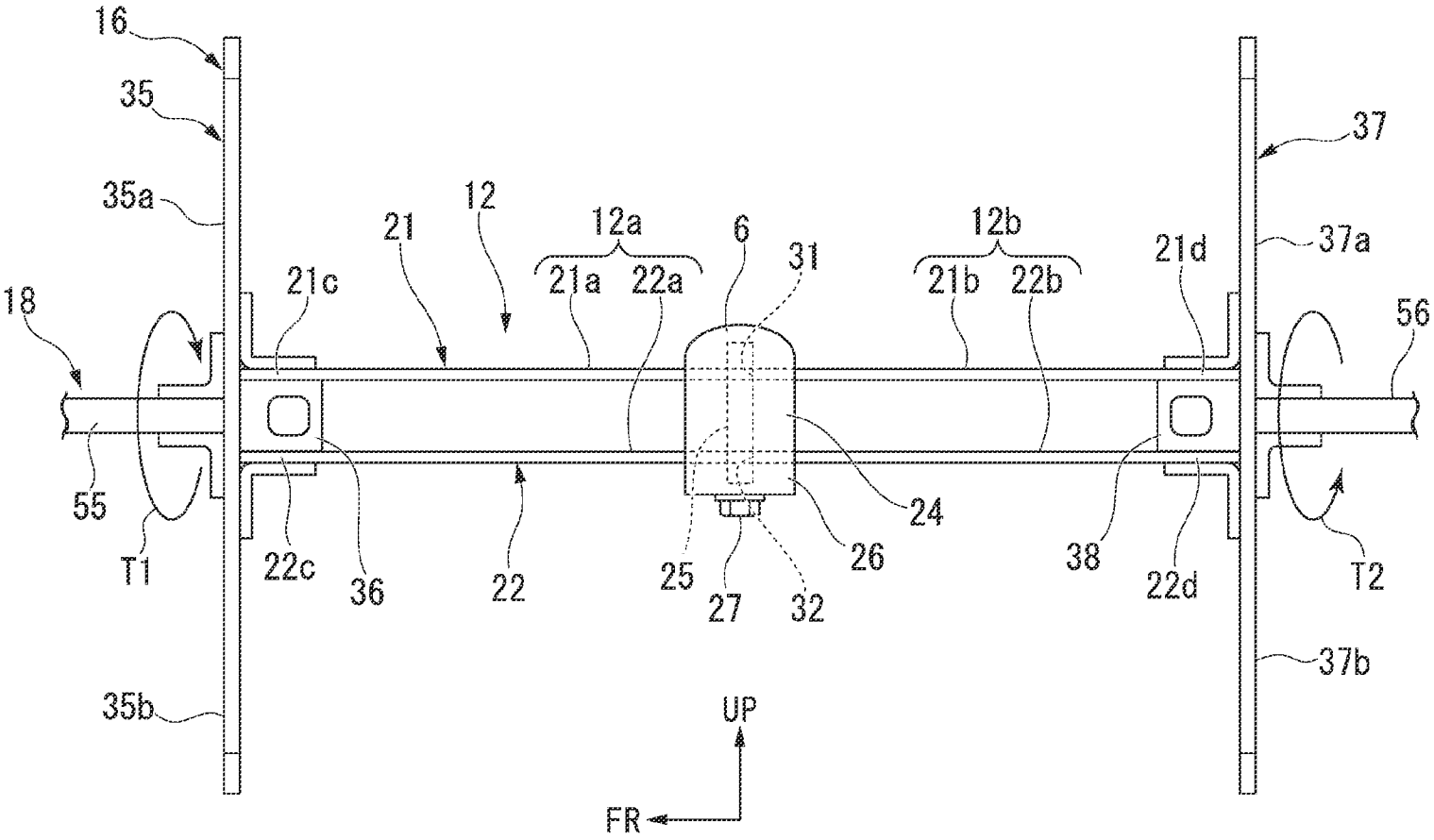
FIG. 5 is a rear view of the steering apparatus of the hydrofoil of FIG. 4, when viewed from a rear side.

As illustrated in FIGS. 4 and 5, the first central connecting portion 21 includes a first through hole (through hole) 31, which penetrates vertically at a central part in the left-right direction. The second central connecting portion 22 includes a second through hole (through hole) 32, which penetrates vertically at a central part in the left-right direction. The first through hole 31 and the second through hole 32 are coaxially disposed vertically. In other words, the first central connecting portion 21 and the second central connecting portion 22 respectively include the first through hole 31 and the second through hole 32, which penetrate through vertically at the central part in the left-right direction.

The support pin 25, facing in the up-down direction, penetrates through the first through hole 31 and the second through hole 32. Accordingly, the central part of the first central connecting portion 21 and the central part of the second central connecting portion 22 (that is, the central part of the central connecting portion 12) are supported by the support pin 25 so that the central connecting portion 12 is rotatable in a substantially horizontal direction. In this state, the first central connecting portion 21 and the second central connecting portion 22 penetrate through a recess or an opening of the support block 24 in the left-right direction.

The central connecting portion 12 is supported by the support pin 25 so as to be rotatable in a substantially horizontal direction, and thus it is possible to permit torsion of the central connecting portion 12. Note that the torsion of the central connecting portion 12 will be described later in detail.

In addition, a margin in rotation (for example, a space in which rotation is enabled with the support pin 25 as the center), not illustrated, is set in the central connecting portion 12. The margin in rotation restricts a rotatable range in which the central connecting portion 12 rotates with the support pin 25 as the center. The central connecting portion 12 rotates within the range of the margin in rotation, and thus it becomes possible to permit the torsion of the central connecting portion 12 (to be described later).

Both end portions of the first central connecting portion 21 and the second central connecting portion 22 are fixed by the fixing portion 16. The fixing portion 16 includes a first fixing portion 35, a first block 36, a second fixing portion 37, and a second block 38.

A central portion in the up-down direction of the first fixing portion 35 is fixed to a first left end portion 21*c* of the first central connecting portion 21 and a second left end portion 22*c* of the second central connecting portion 22.

The first fixing portion 35 includes an upper-side left projecting portion 35*a* and a lower-side left projecting portion 35*b*. The upper-side left projecting portion 35*a* is a part that projects upward from the first left end portion 21*c*. The lower-side left projecting portion 35*b* is a part that projects downward from the second left end portion 22*c*.

The first block 36 is interposed between the first left end portion 21*c* of the first central connecting portion 21 and the second left end portion 22*c* of the second central connecting portion 22. The first block 36 maintains a space between the first left end portion 21*c* of the first central connecting portion 21 and the second left end portion 22*c* of the second central connecting portion 22.

A central portion in the up-down direction of the second fixing portion 37 is fixed to a first right end portion 21*d* of the first central connecting portion 21 and a second right end portion 22*d* of the second central connecting portion 22. The second fixing portion 37 includes an upper-side right projecting portion 37*a* and a lower-side right projecting portion 37*b*. The upper-side right projecting portion 37*a* is a part that projects upward from the first right end portion 21*d*. The lower-side right projecting portion 37*b* is a part that projects downward from the second right end portion 22*d*.

The second block 38 is interposed between the first right end portion 21*d* of the first central connecting portion 21 and the second right end portion 22*d* of the second central connecting portion 22. The second block 38 maintains a space between the first right end portion 21*d* of the first central connecting portion 21 and the second right end portion 22*d* of the second central connecting portion 22.

Next, the torsion of the central connecting portion 12 will be described in accordance with FIGS. 4 to 7.

As illustrated in FIGS. 4 and 5, the first central connecting portion 21 and the second central connecting portion 22 are disposed to be spaced apart from each other vertically, in the central connecting portion 12. In addition, in the central connecting portion 12, the first left end portion 21*c* of the first central connecting portion 21 and the second left end portion 22*c* of the second central connecting portion 22 are fixed by the first fixing portion 35. Furthermore, in the central connecting portion 12, the first right end portion 21*d* of first central connecting portion 21 and the second right end portion 22*d* of the second central connecting portion 22 are fixed by the second fixing portion 37.

Therefore, for example, by generating torque T1 in the first fixing portion 35 in a clockwise direction, when viewed from a right side of the hull, torque in an opposite direction is generated in the first left-side portion 21*a* of the first central connecting portion 21 and the second left-side portion 22*a* of the second central connecting portion 22.

Figure 6:
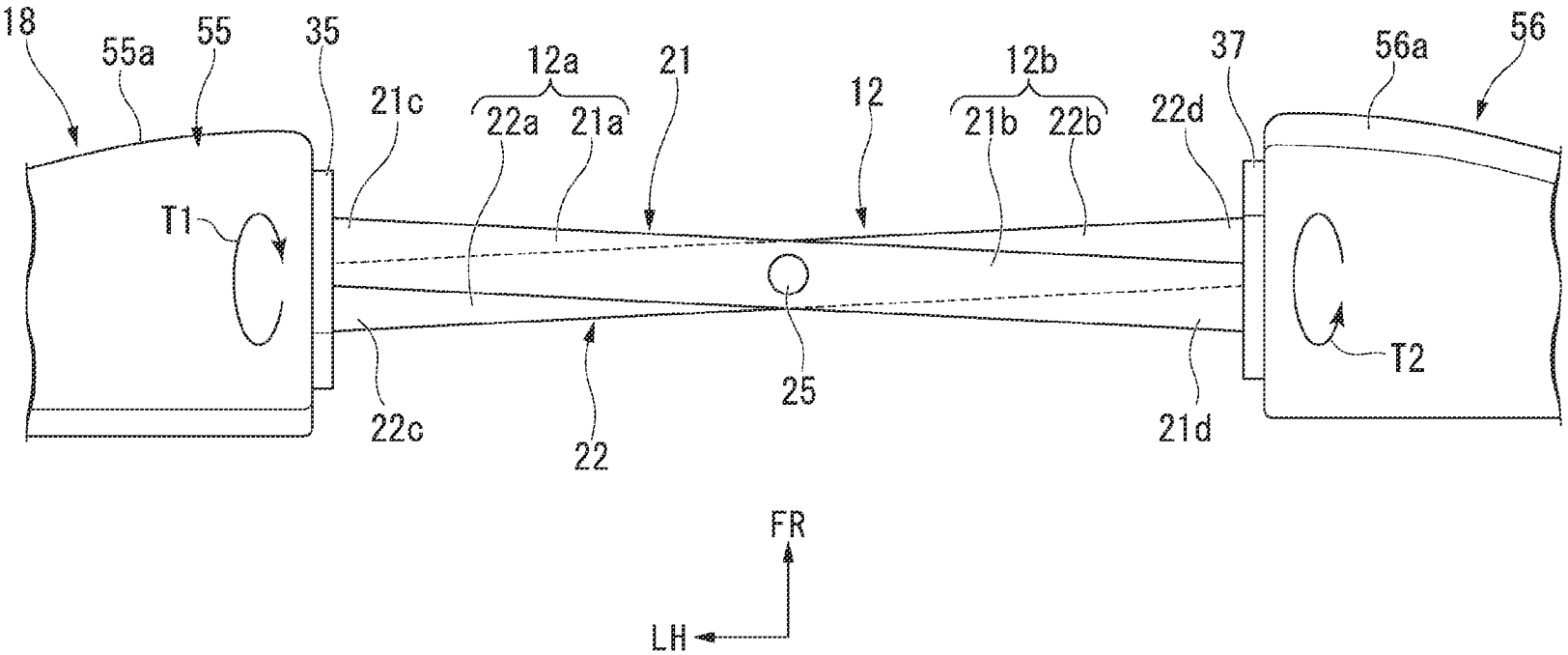
FIG. 6 is a schematic view of a state in which a left end portion of a central connecting portion included in the steering apparatus of the hydrofoil, according to an embodiment, is twisted in a clockwise direction, when viewed from above.

As illustrated in FIG. 6, the first left-side portion 21*a* of the first central connecting portion 21 and the second left-side portion 22*a* of the second central connecting portion 22 are twisted with the support pin 25 as an axis in opposite directions to each other. The twisting of the first left-side portion 21*a* and the twisting of the second left-side portion 22*a* are respectively transmitted to the first right-side portion 21*b* of the first central connecting portion 21 and the second right-side portion 22*b* of the second central connecting portion 22. Accordingly, the first central connecting portion 21 and the second central connecting portion 22 can be twisted in conjunction with each other.

As illustrated in FIGS. 5 and 6, the first central connecting portion 21 is integrally and continuously formed so that the first left-side portion 21*a* and the first right-side portion 21*b* are not divided into left and right parts. Furthermore, the second central connecting portion 22 is integrally and continuously formed so that the second left-side portion 22*a* and the second right-side portion 22*b* are not divided into left and right parts.

Therefore, for example, by generating the torque T1 in the clockwise direction in the first fixing portion 35, the twisting in the clockwise direction occurs in the left-side portion 12*a* of the support pin 25 in the central connecting portion 12. The left-side portion 12*a* of the support pin 25 is twisted in the clockwise direction, and thus the twisting is transmitted to the right-side portion 12*b* of the support pin 25 in the central connecting portion 12.

Specifically, the right-side portion 12*b* of the central connecting portion 12 is linked with the twisting of the left-side portion 12*a*, and the right-side portion 12*b* is twisted in an opposite direction that is a counterclockwise direction, when viewed from a right side of the hull. The right-side portion 12*b* is twisted in the opposite direction, and thus torque T2 in the counterclockwise direction can be generated in the second fixing portion 37.

Figure 7:
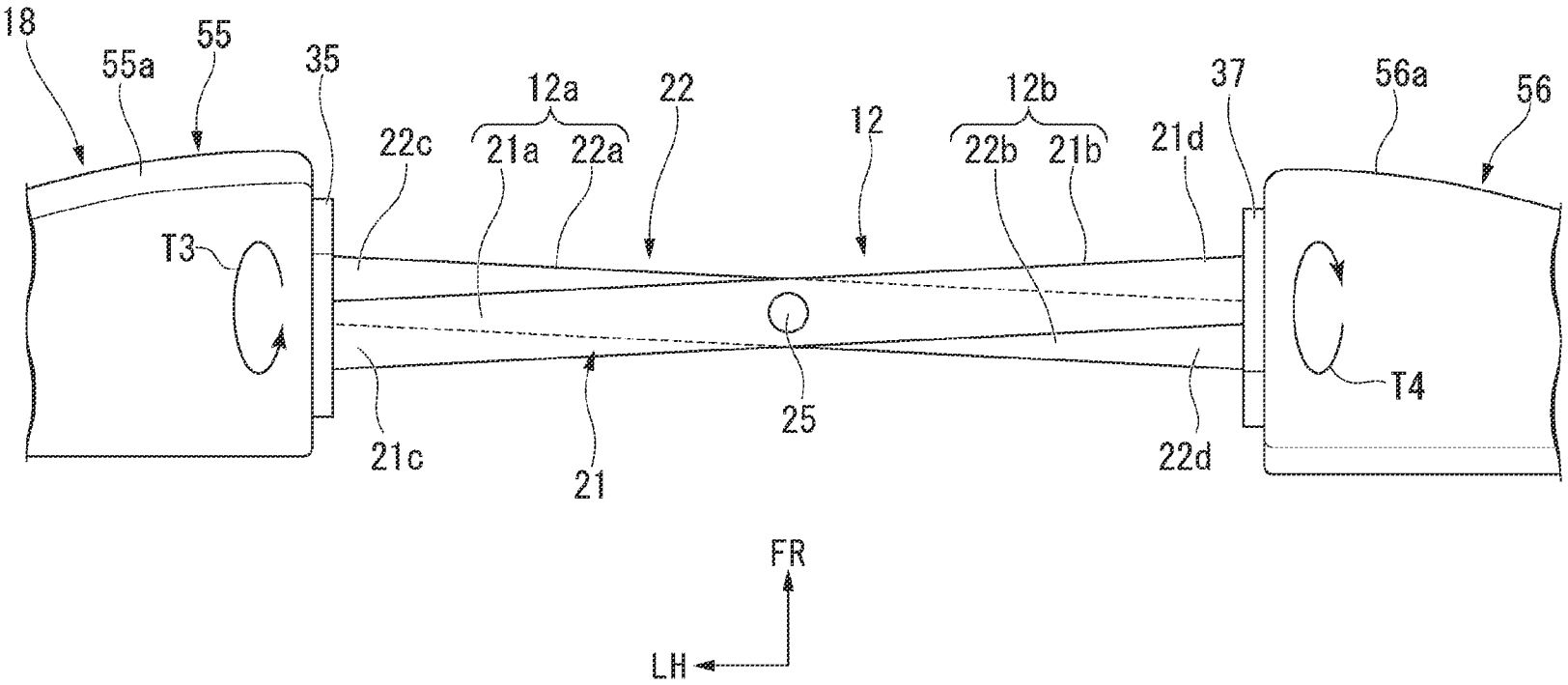
FIG. 7 is a schematic view of a state in which the left end portion of the central connecting portion included in the steering apparatus of the hydrofoil, according to an embodiment, is twisted in a counterclockwise direction, when viewed from above.

In addition, as illustrated in FIG. 7, for example, by generating torque T3 in a counterclockwise direction in the first fixing portion 35, torque T4 in a clockwise direction can be generated in the second fixing portion 37 in an opposite direction.

The first left-side portion 21*a* and the first right-side portion 21*b* of the first central connecting portion 21 are flush with each other. In addition, the second left-side portion 22*a* and the second right-side portion 22*b* of the second central connecting portion 22 are flush with each other.

Therefore, for example, by generating the twisting in the clockwise direction in the left-side portion 12*a* of the central connecting portion 12, the twisting of the left-side portion 12*a* can be efficiently transmitted to the right-side portion 12*b* of the central connecting portion 12. Accordingly, in the central connecting portion 12, the twisting can be generated in the right-side portion 12*b* in conjunction with the twisting of the left-side portion 12*a*.

In addition, in the central connecting portion 12, the first central connecting portion 21 and the second central connecting portion 22 are disposed to be spaced apart from each other vertically. Further, in the central connecting portion 12, the first left-side portion 21*a* and the first right-side portion 21*b* of the first central connecting portion 21 are formed to be continuous with each other in a flat plate shape. Furthermore, in the central connecting portion 12, the second left-side portion 22*a* and the second right-side portion 22*b* of the second central connecting portion 22 are formed to be continuous with each other in a flat plate shape.

Therefore, it becomes possible to have a torsion bar structure (torsion beam structure) with the central connecting portion 12, which is strong against bending, and with which any type of torsional rigidity is obtainable. Accordingly, the twisting can be efficiently generated in the right-side portion 12*b* in conjunction with the twisting generated in the left-side portion 12*a* of the central connecting portion 12.

In addition, the first central connecting portion 21 and the second central connecting portion 22 are disposed to be spaced apart from each other vertically, so as to enable water to pass through between the first central connecting portion 21 and the second central connecting portion 22, while the hydrofoil vessel 1 is being navigated. Accordingly, the resistance of the flow of water to the central connecting portion 12 can be reduced.

Furthermore, the central part of the central connecting portion 12 is rotatably supported by the support pin 25. Therefore, with the support pin 25 as an axis, the left-side portion 12*a* disposed on the left side of the central connecting portion 12 and the right-side portion 12*b* disposed on the right side can be twisted in opposite directions to each other while having the support pin as the axis.

Accordingly, the left-side portion 12*a* and the right-side portion 12*b* of the central connecting portion 12 can be twisted in a simple constitution in which the central part of the central connecting portion 12 is supported by the support pin 25.

In addition, the margin in rotation is set in the central connecting portion 12, and the margin in rotation restricts a rotatable range of the central connecting portion 12. Accordingly, a maximum allowable angle in the torsion of the central connecting portion 12 can be set in a simple constitution in which the margin in rotation is provided in the central connecting portion 12.

As described heretofore, the central connecting portion 12 is formed such that first central connecting portion 21 and second central connecting portion 22 are twisted in opposite directions to each other. Furthermore, the central connecting portion 12 is formed such that the front side of the first central connecting portion 21 and the front side of the second central connecting portion 22 are each twisted in the up-down direction. In addition, the central connecting portion 12 is formed such that the first central connecting portion 21 and the second central connecting portion 22 are twisted in a clockwise direction (that is, a right-hand turn direction) and a counterclockwise direction (that is, a left-hand turn direction) with the support pin 25 as an axis, in a plan view.

Next, the propulsion unit 11 will be described in accordance with FIGS. 1 and 3.

As illustrated in FIGS. 1 and 3, the propulsion unit 11 is attached to the central connecting portion 12 via the first fixing portion 35, the second fixing portion 37, and the like. The propulsion unit 11 is provided between the first fixing portion 35 and the second fixing portion 37.

The propulsion unit 11 includes a plurality of (for example, four in an embodiment) propulsion portions 41, 42, 43, and 44. In the four propulsion portions 41, 42, 43, and 44, by rotating screw propellers (hereinafter, referred to as propellers, in some cases) 46, 47, 48, and 49 with, for example, an electric motor, which is not illustrated, to generate propulsion force, so that the hydrofoil vessel 1 is caused to navigate, for example, at a low speed or at a high speed.

During the low-speed navigation, the hydrofoil vessel 1 floats and sails due to buoyancy of the hull 2. In addition, during the high-speed navigation, the hull 2 floats and sails above a waterline 52 by lift force of the front hydrofoil 8 and the rear hydrofoil 18 (to be described later) of the hydrofoil vessel 1 (hereinafter, this state is referred to as "foilborne").

Hereinafter, the four propulsion portions 41, 42, 43, and 44 will be respectively described as a first propulsion portion 41, a second propulsion portion 42, a third propulsion portion 43, and a fourth propulsion portion 44.

The first propulsion portion 41 and the second propulsion portion 42 are respectively disposed on the left and right sides above the first central connecting portion 21. The first propulsion portion 41 is disposed on the left side of the second propulsion portion 42 above the first central connecting portion 21, and is attached to the upper-side left projecting portion 35*a* of the first fixing portion 35. The second propulsion portion 42 is disposed on the right side of the first propulsion portion 41 above the first central connecting portion 21, and is attached to the upper-side right projecting portion 37*a* of the second fixing portion 37.

Specifically, the first propulsion portion 41 and the second propulsion portion 42, while being disposed above the central connecting portion 12, are connected with the central connecting portion 12 via the first fixing portion 35 and the second fixing portion 37, respectively.

The third propulsion portion 43 and the fourth propulsion portion 44 are respectively disposed on the left and right sides below the second central connecting portion 22. The third propulsion portion 43 is disposed on the left side of the fourth propulsion portion 44 below the second central connecting portion 22, and is attached to the lower-side left projecting portion 35*b* of the first fixing portion 35. The fourth propulsion portion 44 is disposed on the right side of the third propulsion portion 43 below the second central connecting portion 22, and is attached to the lower-side right projecting portion 37*b* of the second fixing portion 37.

Specifically, the third propulsion portion 43 and the fourth propulsion portion 44, while being disposed below the central connecting portion 12, are connected with the central connecting portion 12 via the first fixing portion 35 and the second fixing portion 37, respectively.

As described heretofore, in the propulsion unit 11, the first propulsion portion 41 and the third propulsion portion 43 are provided on the left side of the second propulsion portion 42 and the fourth propulsion portion 44, respectively. In addition, the second propulsion portion 42 and the fourth propulsion portion 44 are provided on the right side of the first propulsion portion 41 and the third propulsion portion 43, respectively. Specifically, the propulsion unit 11 includes at least one propulsion portion (specifically, the first propulsion portion 41, the second propulsion portion 42, the third propulsion portion 43, and the fourth propulsion portion 44) on the left and right sides of the hull 2 in a space between the first fixing portion 35 and the second fixing portion 37.

Further, in the propulsion unit 11, the first propulsion portion 41 and the second propulsion portion 42 are provided above the central connecting portion 12, and the third propulsion portion 43 and the fourth propulsion portion 44 are provided below the central connecting portion 12. Specifically, in the propulsion unit 11, a plurality of propulsion portions including the first propulsion portion 41 and the second propulsion portion 42, and the third propulsion portion 43 and the fourth propulsion portion 44 are provided to be aligned above and below the central connecting portion 12.

Furthermore, the propulsion unit 11 is constituted to generate torsion in the central connecting portion 12 with an output difference in propulsion force of the first propulsion portion 41, the second propulsion portion 42, the third propulsion portion 43, and the fourth propulsion portion 44. An example of generating the torsion in the central connecting portion 12 with the propulsion unit 11 will be described later in detail.

The rear hydrofoil 18 includes a left hydrofoil (fin) 55 disposed on a left outer side of the first fixing portion 35 and a right hydrofoil (fin) 56 disposed on a right outer side of the second fixing portion 37. In the left hydrofoil 55, a base end portion 55*a* is attached to a central portion in the up-down direction of the first fixing portion 35 so as to project to the left outer side from the central portion of the first fixing portion 35. Specifically, the left hydrofoil 55 is attached to the left outer side (outer side) of the central connecting portion 12 via the first fixing portion 35.

In the right hydrofoil 56, a base end portion 56*a* is attached to a central portion in the up-down direction of the second fixing portion 37 so as to project to the right outer side from the central portion of the second fixing portion 37. Specifically, the right hydrofoil 56 is attached to the right outer side (outer side) of the central connecting portion 12 via the second fixing portion 37.

Next, a description will be given for an example in which the hydrofoil vessel 1 is controlled to be in a rolling state, a pitching state, and a yawing state by the steering apparatus 10 in accordance with FIGS. 3, 6, and 7, and Table 1.

Hereinafter, a description will be given assuming that $F1_U$ denotes propulsion force (output) of the first propulsion portion 41, $F2_U$ denotes propulsion force of the second propulsion portion 42, $F1_L$ denotes propulsion force of the third propulsion portion 43, and $F2_L$ denotes propulsion force of the fourth propulsion portion 44.

TABLE 1

| Posture of hydrofoil vessel | | Relationship of propulsion force among first to fourth propulsion portions | First central connecting portion: First left end portion | First central connecting portion: First right end portion | Second central connecting portion: Second left end portion | Second central connecting portion: Second right end portion |
|---|---|---|---|---|---|---|
| Rolling | Port is raised | $F1_U - F1_L < F2_U - F2_L$ | Rearward | Forward | Forward | Rearward |
| | Port is lowered | $F1_U - F1_L > F2_U - F2_L$ | Forward | Rearward | Rearward | Forward |
| Pitching | Vessel bow is raised | $F1_U + F2_U > F1_L + F2_L$ | Front side downward | | Front side downward | |
| | Vessel bow is lowered | $F1_U + F2_U < F1_L + F2_L$ | Front side upward | | Front side upward | |
| Yawing | Turn right | $F1_U + F1_L > F2_U + F2_L$ | Forward | Rearward | Forward | Rearward |
| | Turn left | $F1_U + F1_L < F2_U + F2_L$ | Rearward | Forward | Rearward | Forward |

First, a description will be given for an example in which the hydrofoil vessel 1 is controlled to be in the rolling state.

As illustrated in FIGS. 3 and 7 and Table 1, for example, the first propulsion portion 41 to the fourth propulsion portion 44 are controlled so that the relationship among the propulsion force $F1_U$ to the propulsion force $F2_L$ of the first propulsion portion 41 to the fourth propulsion portion 44 satisfies Formula (1).

$$F1_U - F1_L < F2_U - F2_L \quad (1)$$

In such a controlled state, in the first central connecting portion 21, the first left end portion 21*c* is twisted to a rear side of the hull 2 and the first right end portion 21*d* is twisted to a front side of the hull 2. In the second central connecting portion 22, the second left end portion 22*c* is twisted to the front side of the hull 2, and the second right end portion 22*d* is twisted to the rear side of the hull 2.

Therefore, the torque T3 in the counterclockwise direction is generated in the first fixing portion 35, and the torque T4 in the clockwise direction is generated in the second fixing portion 37 in the opposite directions to each other. Accordingly, a front side 55*b* of the left hydrofoil 55 moves upward, and a front side 56*b* of the right hydrofoil 56 moves downward, so that the attack angles of the left hydrofoil 55 and the right hydrofoil 56 can be changed to opposite directions to each other. Therefore, the hydrofoil vessel 1 is controlled to a direction in which the port is raised.

In addition, as illustrated in FIGS. 3 and 6 and Table 1, for example, the first propulsion portion 41 to the fourth propulsion portion 44 are controlled so that the relationship among the propulsion force $F1_U$ to the propulsion force $F2_L$ of the first propulsion portion 41 to the fourth propulsion portion 44 satisfies Formula (2).

$$F1_U - F1_L > F2_U - F2_L \quad (2)$$

In such a controlled state, in the first central connecting portion 21, the first left end portion 21*c* is twisted to a front side of the hull 2, and the first right end portion 21*d* is twisted to a rear side of the hull 2. In the second central connecting portion 22, the second left end portion 22*c* is twisted to the rear side of the hull 2, and the second right end portion 22*d* is twisted to the front side of the hull 2.

Therefore, the torque T1 in the clockwise direction is generated in the first fixing portion 35, and the torque T2 in the counterclockwise direction is generated in the second fixing portion 37 in the opposite directions to each other. Accordingly, the front side 55*b* of the left hydrofoil 55 moves downward, and the front side 56*b* of the right hydrofoil 56 moves upward, so that the attack angles of the left hydrofoil 55 and the right hydrofoil 56 can be changed in opposite directions to each other. Therefore, the hydrofoil vessel 1 is controlled to a direction in which the port is lowered.

Next, a description will be given for an example in which the hydrofoil vessel 1 is controlled to be in the pitching state.

As illustrated in FIG. 3 and Table 1, for example, the first propulsion portion 41 to the fourth propulsion portion 44 are controlled so that the relationship among the propulsion force $F1_U$ to the propulsion force $F2_L$ of the first propulsion portion 41 to the fourth propulsion portion 44 satisfies Formula (3).

$$F1_U+F2_U>F1_L+F2_L \quad (3)$$

In such a controlled state, the first central connecting portion 21 and the second central connecting portion 22 are twisted such that their respective front sides move downward.

Therefore, torque in the clockwise direction is generated in the first fixing portion 35 and the second fixing portion 37. Accordingly, the front side 55*b* of the left hydrofoil 55 and the front side 56*b* of the right hydrofoil 56 move downward, so that the left hydrofoil 55 and the right hydrofoil 56 sink downward. Therefore, the hydrofoil vessel 1 is controlled to a direction in which a vessel bow 2*c* is raised.

In addition, for example, the first propulsion portion 41 to the fourth propulsion portion 44 are controlled so that the relationship among the propulsion force $F1_U$ to the propulsion force $F2_L$ of the first propulsion portion 41 to the fourth propulsion portion 44 satisfies Formula (4).

$$F1_U+F2_U<F1_L+F2_L \quad (4)$$

In such a controlled state, the first central connecting portion 21 and the second central connecting portion 22 are twisted such that their respective front sides move upward.

Therefore, torque in the counterclockwise direction is generated in the first fixing portion 35 and the second fixing portion 37. Accordingly, the front side 55*b* of the left hydrofoil 55 and the front side 56*b* of the right hydrofoil 56 move upward, so that the left hydrofoil 55 and the right hydrofoil 56 float upward. Therefore, the hydrofoil vessel 1 is controlled to a direction in which the vessel bow 2*c* is lowered.

Subsequently, a description will be given for an example in which the hydrofoil vessel 1 is controlled to be in the yawing state.

In addition, for example, the first propulsion portion 41 to the fourth propulsion portion 44 are controlled so that the relationship among the propulsion force $F1_U$ to the propulsion force $F2_L$ of the first propulsion portion 41 to the fourth propulsion portion 44 satisfies Formula (5).

$$F1_U+F1_L>F2_U+F2_L \quad (5)$$

In this manner, the propulsion force ($F1_U$+$F1_L$) of the first propulsion portion 41 on the left side and the third propulsion portion 43 on the left side is larger than the propulsion force ($F2_U$+$F2_L$) of the second propulsion portion 42 on the right side and the fourth propulsion portion 44 on the right side. Accordingly, the hydrofoil vessel 1 is controlled to turn to the right.

Furthermore, in such a controlled state, for example, by satisfying the relationship of $F1_U<F1_L$, $F2_U>F2_L$, the front side 55*b* of the left hydrofoil 55 moves upward, and the front side 56*b* of the right hydrofoil 56 moves downward. Specifically, the respective attack angles of the left hydrofoil 55 and the right hydrofoil 56 can be changed in opposite directions to each other. Accordingly, the hydrofoil vessel 1 can be caused to turn to the right in a more smooth manner, and the driving force (for example, electric power) for causing the hull 2 to make a turn can be reduced.

In addition, for example, the first propulsion portion 41 to the fourth propulsion portion 44 are controlled so that the relationship among the propulsion force $F1_U$ to the propulsion force $F2_L$ of the first propulsion portion 41 to the fourth propulsion portion 44 satisfies Formula (6).

$$F1_U+F1_L<F2_U+F2_L \quad (6)$$

Thus, the propulsion force ($F2_U$+$F2_L$) of the second propulsion portion 42 on the right side and the fourth propulsion portion 44 on the right side is larger than the propulsion force ($F1_U$+$F1_L$) of the first propulsion portion 41 on the left side and the third propulsion portion 43 on the left side. Accordingly, the hydrofoil vessel 1 is controlled to turn to the left.

Furthermore, in such a controlled state, for example, by satisfying the relationship of $F1_U>F1_L$, $F2_U<F2_L$, the front side 55*b* of the left hydrofoil 55 moves downward, and the front side 56*b* of the right hydrofoil 56 moves upward. Specifically, the respective attack angles of the left hydrofoil 55 and the right hydrofoil 56 can be changed in opposite directions to each other. Accordingly, the hydrofoil vessel 1 can be caused to turn to the left in a more smooth manner, and the driving force (for example, electric power) for causing the hull 2 to make a turn can be reduced.

As described heretofore, according to the steering apparatus 10 in an embodiment, as illustrated in FIGS. 3 and 4, the first propulsion portion 41 and the second propulsion portion 42 are respectively disposed on the left and right sides above the first central connecting portion 21 (that is, the central connecting portion 12). In addition, the first propulsion portion 41 and the second propulsion portion 42 are respectively connected with the central connecting portion 12 through the first fixing portion 35 and the second fixing portion 37.

Furthermore, the third propulsion portion 43 and the fourth propulsion portion 44 are respectively disposed on the left and right sides below the second central connecting portion 22 (that is, the central connecting portion 12). Further, the third propulsion portion 43 and the fourth propulsion portion 44 are connected with the central connecting portion 12 through the first fixing portion 35 and the second fixing portion 37, respectively.

Additionally, the left hydrofoil 55 is attached to the left outer side of the central connecting portion 12, and the right hydrofoil 56 is attached to the right outer side of the central connecting portion 12.

Therefore, for example, by generating an output difference in the propulsion force between one side and the other side among the first to fourth propulsion portions 41 to 44 disposed on the left and right sides, the torsion can be generated in the central connecting portion 12. Accordingly, the attack angle on one side and that of the other side of the left hydrofoil 55 and the right hydrofoil 56 respectively disposed on the left and right sides can be changed in opposite directions to each other. Therefore, for example, in causing the hull 2 to make a turn through steering, it is possible to cause the hull 2 to make a turn in a smooth manner.

In addition, according to the steering apparatus 10, the first propulsion portion 41 and the second propulsion portion 42, and the third propulsion portion 43 and the fourth propulsion portion 44 are provided next to each other in vertical direction. Therefore, the torsion can be generated in the central connecting portion 12 by an output difference in the propulsion force between the first propulsion portion 41 and the second propulsion portion 42 provided on an upper side, and the third propulsion portion 43 and the fourth propulsion portion 44 provided on a lower side.

Accordingly, among the left hydrofoil 55 and the right hydrofoil 56 disposed on the left and right sides, respectively, the attack angle of one side and the attack angle of the other side can be changed in opposite directions to each other. Therefore, for example, in causing the hull 2 to make a turn through steering, it is possible to cause the hull 2 to make a turn in a smooth manner, and the driving force (for example, electric power) in causing the hull 2 to make a turn can be reduced.

Note that the technical scope of the present invention is not limited to the above embodiment, and various changes can be made without departing from the scope of the present invention.

For example, in the above embodiments, the description has been given for an example in which the propulsion force of the first to fourth propulsion portions 41 to 44 is generated by the propellers. However, the present invention is not limited to this. As another example, the propulsion force of the first to fourth propulsion portions may be generated by a water jet, for example.

In addition, in the above embodiment, the description has been given for an example in which four propulsion portions (the first propulsion portion 41, the second propulsion portion 42, the third propulsion portion 43, and the fourth propulsion portion 44) are provided as the propulsion unit 11. However, the present invention is not limited to this. As another example, any number of the propulsion portions is selectable.

Furthermore, in the above embodiment, the description has been given for an example in which the central connecting portion 12 includes two pieces of the first central connecting portion 21 and the second central connecting portion 22 provided vertically. However, the present invention is not limited to this. As another example, for example, the central connecting portion 12 may be formed of one piece.

Additionally, in the above embodiment, the description is given for an example in which one side is described as a left side and the other side is described as a right side in some cases. However, the present invention is not limited to this. One side may be the right side, and the other side may be the left side. Also in this case, the same operations and effects as those of the embodiment in which one side is the left side and the other side is the right side are obtainable.

In addition, in the above embodiment, the description has been given for an example in which the front hydrofoil 8 is provided as a fixed wing on the front side of the hydrofoil vessel 1 and the steering apparatus 10 is provided on the rear side of the hydrofoil vessel 1. However, the present invention is not limited to this. As another example, for example, a fixed wing may be provided on the rear side of the hydrofoil vessel 1, and a steering apparatus may be provided on the front side of the hydrofoil vessel 1.

In addition, it is possible to appropriately replace the constituent elements in the embodiments with well-known constituent elements without departing from the scope of the present invention, and the above modifications may be appropriately combined.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. A steering apparatus of a hydrofoil, the steering apparatus comprising:
- at least one propulsion component each on a left side and on a right side;
- a central connecting structure that connects the propulsion portion components with each other;
- a support structure that comprises a support block and a support pin; and
- a fin attached to an outer side of the central connecting structure, wherein the central connecting structure comprises
- a first central connecting structure and a second central connecting structure which are disposed vertically as two pieces,
- wherein central portions of the first central connecting structure and the second central connecting structure in the left-right direction are supported in a state penetrating through an opening formed in the support block in the left-right direction, and
- the support pin vertically penetrates a through hole formed in each of the central portions of the first central connecting structure and the second central connecting structure in the left-right direction and supports the central connecting structure at inside of the support block.

2. The steering apparatus of the hydrofoil according to claim 1, further comprising:
- a first fixing structure that fixes each left side of the first central connecting structure and the second central connecting structure, the first fixing structure being attached with the fin disposed on a left outer side; and
- a second fixing structure that fixes each right side of the first central connecting structure and the second central connecting structure, the second fixing structure being attached with the fin disposed on a right outer side.

3. The steering apparatus of the hydrofoil according to claim 1, wherein
- each of the first central connecting structure and the second central connecting structure is formed in a flat plate shape.

4. The steering apparatus of the hydrofoil according to claim 1, wherein
- a space in which rotation is enabled, with the support pin as a center is set in the central connecting structure, restricts a rotatable range in which the central connecting structure rotates with the support pin as the center.

5. The steering apparatus of the hydrofoil according to claim 1, wherein
- a plurality of the propulsion components are provided next to each other in a vertical direction of the central connecting structure, and
- the central connecting structure is twisted by an output difference in propulsion force of the propulsion components provided vertically.

* * * * *